US005747391A

United States Patent [19]

Neubach

[11] Patent Number: 5,747,391

[45] Date of Patent: May 5, 1998

[54] BACKED NONWOVENS PREPARED FROM SYNTHETIC FIBERS

[75] Inventor: Werner Neubach, Ludwigshafen, Germany

[73] Assignee: Bayer Aktiengesellschaft, Leverkusen, Germany

[21] Appl. No.: 775,058

[22] Filed: Dec. 27, 1996

Related U.S. Application Data

[63] Continuation of Ser. No. 376,949, Jan. 20, 1995, abandoned.

[30] Foreign Application Priority Data

Jan. 26, 1994 [DE] Germany ..... 44 02 187.9

[51] Int. Cl.[6] ..... D04H 1/64

[52] U.S. Cl. ..... 442/70; 442/74; 442/417

[58] Field of Search ..... 442/70, 72, 74, 442/417

[56] References Cited

U.S. PATENT DOCUMENTS

| | | | |
|---|---|---|---|
| 2,941,904 | 6/1960 | Stalego . | |
| 3,944,702 | 3/1976 | Clark | 428/288 |
| 3,976,525 | 8/1976 | Mednick | 156/72 |
| 4,957,963 | 9/1990 | Burns et al. | 524/837 |
| 4,986,908 | 1/1991 | Stout et al. | 210/198.2 |
| 5,207,047 | 5/1993 | Prignitz | 52/743 |
| 5,354,803 | 10/1994 | Dragner et al. | 524/503 |
| 5,389,716 | 2/1995 | Graves | 524/510 |
| 5,447,676 | 9/1995 | Fukuda et al. | 264/331.18 |

FOREIGN PATENT DOCUMENTS

| | | |
|---|---|---|
| 2243293 | 4/1975 | France . |
| 2276279 | 1/1976 | France . |
| 2916316 | 11/1979 | Germany . |
| 9307202 | 4/1993 | WIPO . |

OTHER PUBLICATIONS

Determination of Specific Surface Area of Colloidal Silica by Titration With Sodium Hydroxide, George W. Sears Jr, vol. 28, No. 12, pp. 1981–1983 (1956).

*Primary Examiner*—Kathleen Choi
*Attorney, Agent, or Firm*—Sprung Kramer Schaefer & Briscoe

[57] ABSTRACT

In the production of a backed nonwoven fabric by needle-punching, calendaring or heat treatment of a spun-bonded or fiber nonwoven produced from a polymer or synthetic fiber, subsequent further processing of the resultant nonwoven with an aqueous solution or dispersion of a crosslinkable polymer or melamine resin and subsequent drying and coating with bitumen or PVC plastisol, the improvement wherein the solution or dispersion contains silica sol in a quantity such that the weight ratio of polymer:$SiO_2$ is from about 3:1 to 1:3 and the weight ratio of melamine resin:$SiO_2$ is from about 10:1 to 1:1. The products have improved tear strength and dimensional stability.

4 Claims, No Drawings

BACKED NONWOVENS PREPARED FROM SYNTHETIC FIBERS

This application is a continuation, of application Ser. No. 08/376,949, filed on Jan. 20, 1995 which is now abandoned.

The present invention relates to nonwovens and covering materials produced from them which have particularly good tear strength and dimensional stability, and to a process for the production thereof.

Spun-bonded nonwovens produced from polymers and fiber nonwovens produced from synthetic or mineral fibers are known per se. Nonwovens produced from fibers are initially subjected to mechanical treatment to felt or mechanically prebond the fibers. Prebonding is achieved by needle-punching, calendering or, in the case of nonwovens produced from various synthetic fibers, by heat treatment to fuse the fibers. The resultant nonwovens are subsequently impregnated with crosslinkable polymers in order, once the polymers have been crosslinked and dried, to impart the desired strength to the nonwovens. Nonwovens which have been coated in an additional processing stage are known as backed nonwovens. They have many industrial applications.

It is known from DE-OS 2 916 316 to produce nonwovens with a binder mixture prepared from latex and silica sol. In this manner, migration of the latex material on drying is reduced and the resultant nonwovens have good properties. The binder mixture is one heretofore used in the production of paper, nonwoven material and latex paint.

DE-OS 3 001 075 describes the addition of silica sol as filler to a latex without this causing increased chalking on the surface of a needle-punched carpet produced with this mixture.

In DE-A 4 031 240, glass fibers are coated with aqueous solutions based on silica sol before production of the nonwoven in order to increase chemical resistance and storage stability.

It is understood that the specification and examples are illustrative but not limitative of the present invention and that other embodiment within the spirit and scope of the invention will suggest themselves to those skilled in the art.

Nonwovens hitherto produced from polymers and from synthetic or mineral fibers which are bonded with polymers or resins are used on a large scale industrially, in particular as carriers for covering materials. The demands placed on the nonwovens in terms of strength and dimensional stability under load and the action of heat are high, such that particular attention must be paid to ensuring that the fiber structure of the nonwovens, prebonding and final chemical bonding are all optimized one to the other. Despite such measures, dimensional stability under load and the action of heat is still unsatisfactory.

The object of the present invention is thus to provide nonwovens which are sufficiently dimensionally stable even under extreme loads and the action of heat, such that they may be used in covering materials such as, for example, roofing, sealing materials, and the like.

This object is achieved with the dimensionally stable nonwovens according to the invention, wherein the other properties of the nonwoven, such as for example tear strength and elongation at break, are not impaired.

The present invention provides nonwovens prepared from synthetic fibers together with crosslinked polymer and $SiO_2$ in a weight ratio of 3:1 to 1:3, preferably 2:1 to 1:2 or melamine resin and $SiO_2$ in a weight ratio of 10:1 to 1:1.

The present invention also provides a process for the production of nonwovens by needle-punching, calendering or heat treatment of spun-bonded or fiber nonwovens produced from polymers or synthetic fibers, subsequent further processing of the resultant nonwovens with aqueous solutions or dispersions of crosslinkable polymers or melamine resins to produce a nonwoven and subsequent drying, wherein the solution or dispersion contains, additionally or instead of a proportion of the polymers or melamine resins, silica sol in a quantity such that the weight ratio of polymer to $SiO_2$ is 3:1 to 1:3, preferably 2:1 to 1:2, or the weight ratio of melamine resin to $SiO_2$ is 10:1 to 1:1.

The nonwovens according to the invention are preferably used as sealing materials for dams and landfill sites.

The present invention also provides backed nonwovens produced from the nonwovens according to the invention provided with a coating of bitumen or PVC plastisol.

The present invention also provides a process for the production of backed nonwovens by needle-punching, calendering or heat treatment of spun-bonded or fiber nonwovens produced from polymers or synthetic fibers, subsequent further processing of the resultant nonwovens with aqueous solutions or dispersions of crosslinkable polymers or melamine resins and subsequent drying, wherein the solution or dispersion contains, additionally or instead of a proportion of the polymers or melamine resins, silica sol in a quantity such that the weight ratio of polymer to $SiO_2$ is 3:1 to 1:3, preferably 2:1 to 1:2, or the weight ratio of melamine resin to $SiO_2$ is 10:1 to 1:1 and after processing the nonwoven is coated with bitumen or PVC plastisol at temperatures of 160° to 230° C.

The backed nonwovens according to the invention are preferably used as covering materials, such as roofing and sealing materials for dams and landfill sites. Thanks to their elevated dimensional stability, these materials may be used under severe weather conditions, such as in particular major fluctuations in temperature.

The synthetic fibers which are preferably used are polyamide fibers (nylon fibers), polyolefinic fibers or preferably polyester fibers, particularly preferably polyester fibers based on p-terephthalic acid and ethylene glycol. Other fibers such as mineral fibers, e.g. glass fiber, as well as polyolefin or nylon fibers can also be used.

Aqueous dispersions of crosslinkable polymers based on styrene/butadiene or acrylate and various crosslinking components or aqueous solutions of modified melamine resins are preferred. The crosslinkable polymers which may be used as binder must have thermosetting properties. Thermosetting behavior of the binder is achieved by selecting suitable monomers or by incorporating crosslinking components into the polymers. Co- and terpolymers prepared from acrylic acid esters, acrylamides and acrylonitrile together with styrene and butadiene are thus particularly preferred. In order to achieve water solubility, the melamine resins are customarily modified by containing condensed amidosulphonic acid, caprolactam or diethylene glycol.

In order to achieve complete crosslinking of the polymers under customary drying conditions, preferably acids or latent acid donors are added to the polymer dispersions and preferably catalytically active salts of neutral pH or latent acid donors are added to the melamine resin solutions.

The addition of silica sol or partial replacement of the polymers/melamine resins with silica sol according to the invention substantially improves the dimensional stability of the nonwoven or the covering material, both under load and under the simultaneous action of heat, wherein the remaining properties remain unchanged or are even improved in part.

It is surprising at these high quantities of added $SiO_2$ that polymer crosslinking is not impaired. Moreover, addition of $SiO_2$ does not lead to the expected embrittlement or hardening of the nonwovens in comparison with nonwovens without added $SiO_2$. Tensile strength and solvent resistance are the same as those without added $SiO_2$.

The fibers and the binder are preferably used in a weight ratio of fibers:binder (dry) of from 10:0.1 to 10:3.5, more preferably from 10:0.5 to 10:2.5.

For the production of covering materials, 0.5 to 3.5 $kg/m^2$ of coating material (backing material) are preferably applied. On a dry basis, the ratio of fiber: coating material generally ranges between about 10:0.1 and 10:3.5, preferably between about 10:0.5 and 10:2.5.

The preferably used silica sols are colloidal solutions of amorphous silicon dioxide in water, which are also known as silicon dioxide sols or silicic acid sols. The silicon dioxide is present in such sols in the form of predominantly spherical particles hydroxylated on the surface. The diameter of the colloid particles is 1–100 nm, wherein the specific BET surface area (determined using the method of G. N. Sears, Analytical Chemistry, vol. 28, no. 12, 1981–1983, December 1956), which correlates to particle size, is 50–1000 $m^2/g$.

Alkali-stabilized silica sols have a slightly alkaline pH value and contain as alkalizing agent small quantities of $Na_2O$, $K_2O$, $Li_2O$ or ammonium or alkali aluminates. Silica sols may, however, also be weakly acidic as semi-stable colloidal solutions. It is also possible to use silica sols which have been rendered cationic with a coating of $Al_2(OH)_5Cl$.

The concentration of the silica sols is preferably 5 to 60 wt. % $SiO_2$, in particular 15 to 50 wt. % $SiO_2$.

The following examples are intended to illustrate the invention.

EXAMPLE 1

200 parts of a 50% polymer dispersion based on butyl acrylate and acrylonitrile with a crosslinking component and 330 parts of Levasil® 300/30% (anionic silica sol, specific BET surface area 300 $m^2/g$, 30 wt. % $SiO_2$) are mixed together (weight ratio of polymer to $SiO_2$ of 1:1). The mixture is diluted with water to a total solids content of approximately 20 wt. %. The mixture is acidified to pH 3 to 4 with oxalic acid.

A spun-bonded polyester nonwoven of approximately 150 $g/m^2$ based on p-terephthalic acid and ethylene glycol is prebonded using a needle-punching process.

This nonwoven is then immersed in the above-stated mixture and then squeezed out to a moisture uptake of 150 $g/m^2$ (20% solids related to dry nonwoven). Drying is performed at 150° to 160° C.

Levasil® silica sol is a product of Bayer AG, Leverkusen.

EXAMPLE 2

200 parts of a butadiene/styrene latex having a butadiene/styrene ratio of 1:1.05 and a crosslinking component based on a methylolacrylamide are combined with 178 parts of Levasil® 100/45% (anionic silica sol, specific surface area 100 $m^2/g$, 45 wt. % $SiO_2$) and diluted with water to a solids content of 20%. 1.5 g of ammonium sulphate are dissolved in water and added to the mixture. The mixture is foamed by adding a surface-active substance (sodium dodecylbenzenesulphonate). The foam is applied to a spun-bonded nonwoven of approximately 170 $g/m^2$ produced from endless polyester filament and previously prebonded by calendering in such a manner that after compression and suction the mixture is applied at a rate of approximately 170 $g/m^2$. Drying is performed at 150° to 180° C.

EXAMPLE 3

200 parts of a 50% aqueous solution of a modified melamine resin are combined with 100 parts of Levasil® 300/30% (anionic silica sol, specific surface area 300 $m^2/g$, 30 wt. % $SiO_2$) and diluted with water to a solids content of 20%. 4 g of a 20% magnesium sulphate solution are then added. A nonwoven of approximately 260 $g/m^2$ produced from polyester staple fibers by carding, laying and needle-punching is impregnated with the above solution and squeezed out to a moisture uptake of approximately 260 $g/cm^2$. Drying is performed at 180° to 200° C.

The nonwovens from Examples 1 to 3 are compared with nonwovens without added $SiO_2$. The nonwovens from Examples 1 and 2 have strengths (measured at room temperature) which are approximately identical to those without added $SiO_2$. The elongation values at 180° C. of the nonwovens 1 and 2 according to the invention are approximately 20% higher than those of prior art nonwovens.

The strength of the nonwoven from Example 3 was 10% greater than that of the corresponding nonwoven without $SiO_2$. Elongation values were approximately identical.

Bitumen roof coverings produced with the nonwovens according to the invention have better elongation behavior and greater dimensional stability under the action of heat than nonwovens produced without $SiO_2$ and coated with bitumen.

The novel nonwovens can be formed into roof coverings in conventional manner. For example, they can be introduced into a hot bitumen bath and then pressed to the required application thickness by two calibrating rollers. Modifications with APP (atactic PP) or SBS (styrene/butadiene/styrene polymer) are currently used in addition to pure bitumen. Consequently, and due to the various viscosity requirements for obtaining the required weight of the coating, the bath temperature can vary between 160° C. and 220° C. After adjusting the bitumen layer (weight of coating), sand is sprinkled on both sides, and the backed nonwoven is cooled and wound into a roll. The coating weights (bitumen+sand) are 2–4 $kg/m^2$.

For coating with PVC-plastisol, the following composition is representative:

100 parts by weight of a PVC capable of forming a paste

40–45 parts of plasticiser (phthalic acid ester of $C_8$–$C_{11}$ alcohols)

10–15 parts of a filler (e.g. kaolin) and colored pigments

1–2 of stabilizers, fungicides, etc.

The paste is applied with a doctor blade in one or more passes. The coating weights are generally somewhat lower than with bitumens and are approximately 1–3 $kg/m^2$. The fusion temperature is between 170°–200° C., depending on the plasticizer used and the coating weight.

It will be understood that the specification and examples are illustrative but not limitative of the present invention and that other embodiments within the spirit and scope of the invention will suggest themselves to those skilled in the art.

I claim:

1. A nonwoven fabric comprising synthetic fibers bonded with a crosslinked polymer or melamine resin containing $SiO_2$, the weight ratio of polymer:$SiO_2$ ranging from about 3:1 to 1:3 and the weight ratio of melamine resin:$SiO_2$ ranging from about 10:1 to 1:1, the nonwoven fabric having been produced by applying to an unbonded nonwoven fabric a bonding composition consisting of an aqueous solution or dispersion of a) a croselinkable polymer with thermosetting properties based on i) styrene/butadiene or acrylate and crosslinking components, or ii) copolymers acrylic acid ester, acrylamides and acrylonitrile together with styrene and butadiene, or b) a melamine resin or a modified melamine resin and c) aqueous colloidal silica particles having diameters of 1–100 nm and BET surface areas of 50–1000 $m^2/g$ and subsequently drying to crosslink said resin or crosslinkable polymer.

2. A nonwoven fabric according to claim 1, wherein the weight ratio of polymer:$SiO_2$ is from about 2:1 to 1:2.

3. A nonwoven fabric according to claim 1, carrying a backing.

4. A nonwoven fabric according to claim 3, wherein the backing is bitumen or PVC plastisol.

* * * * *

UNITED STATES PATENT AND TRADEMARK OFFICE

CERTIFICATE OF CORRECTION

PATENT NO : 5,747,391

DATED : May 5, 1998

INVENTOR(S) : Neubach, Werner

It is certified that error appears in the above-identified patent and that said Letters Patent is hereby corrected as shown below:

| | |
|---|---|
| Col. 4, Line 64 | Delete "croselinkable" and substitute --crosslinkable-- |
| Col. 5, Line 1 | After "copolymers" insert --prepared from one or more of-- |

Signed and Sealed this

Sixteenth Day of November, 1999

*Attest:*

*Attesting Officer*

Q. TODD DICKINSON

*Acting Commissioner of Patents and Trademarks*